US007637407B2

(12) United States Patent
Shor

(10) Patent No.: US 7,637,407 B2
(45) Date of Patent: Dec. 29, 2009

(54) FASTENER GUN

(75) Inventor: Ilya Shor, Brooklyn, NY (US)

(73) Assignee: Arrow Fastener Co., Inc., Saddle Brook, NJ (US)

( * ) Notice: Subject to any disclaimer, the term of this patent is extended or adjusted under 35 U.S.C. 154(b) by 0 days.

(21) Appl. No.: 11/685,281

(22) Filed: Mar. 13, 2007

(65) Prior Publication Data

US 2008/0223897 A1 Sep. 18, 2008

(51) Int. Cl.
*B25C 5/11* (2006.01)

(52) U.S. Cl. ..... 227/132; 227/134; 227/120; 227/146

(58) Field of Classification Search ..... 227/132, 227/134, 120, 146
See application file for complete search history.

(56) References Cited

U.S. PATENT DOCUMENTS

| | | | | |
|---|---|---|---|---|
| 1,830,650 | A | 11/1931 | Falk | |
| 2,028,350 | A * | 1/1936 | Polzer | 227/134 |
| 2,493,640 | A | 1/1950 | Peterson | |
| 2,617,097 | A | 11/1952 | Spencer | |
| 2,746,043 | A | 5/1956 | Heller | |
| 2,775,763 | A | 1/1957 | Flammer | |
| 3,229,882 | A | 1/1966 | Abrams | |
| 5,165,587 | A | 11/1992 | Marks | |
| 5,328,075 | A | 7/1994 | Marks | |
| 5,335,839 | A | 8/1994 | Fealey | |
| 5,407,118 | A | 4/1995 | Marks | |
| 5,427,299 | A | 6/1995 | Marks | |
| 5,505,362 | A | 4/1996 | Marks | |
| 5,511,716 | A | 4/1996 | Marks | |
| 5,664,722 | A | 9/1997 | Marks | |
| 5,699,949 | A | 12/1997 | Marks | |
| 5,758,813 | A | 6/1998 | Kikuchi et al. | |
| 5,765,742 | A | 6/1998 | Marks | |
| 5,816,470 | A * | 10/1998 | Plato et al. | 227/132 |
| 5,890,642 | A | 4/1999 | Sato | |
| 5,979,736 | A | 11/1999 | Edeholt | |
| 5,988,478 | A * | 11/1999 | Marks | 227/132 |
| 6,789,719 | B2 | 9/2004 | Shor | |
| 7,097,088 | B2 | 8/2006 | Shor | |
| 7,252,217 | B1 * | 8/2007 | Lin | 227/8 |

* cited by examiner

*Primary Examiner*—Paul R. Durand
*Assistant Examiner*—Michelle Lopez
(74) *Attorney, Agent, or Firm*—Carlson, Gaskey & Olds

(57) ABSTRACT

An example fastener gun includes a housing having a plunger and a power spring for driving a fastener into a workpiece, and a trigger arm pivotally attached to the housing at a trigger pivot. The trigger arm lifts the plunger to bias the power spring when the trigger arm pivots in a first direction. The example fastener gun also includes a handle extending upwardly from the housing and pivotally attached to the housing at a handle pivot, and a roller for pivoting trigger arm in the first direction when the handle moves toward the housing. The roller moves away from the trigger pivot when the handle moves toward the housing.

12 Claims, 3 Drawing Sheets

FASTENER GUN

BACKGROUND OF THE INVENTION

This invention relates to a fastener gun for driving a fastener.

Fastener guns are known in the art and include a handle pivotally attached to a fastener gun housing. Rotating the handle toward the fastener housing biases a power spring. A user's hand, received on an end of the handle remote from the pivot, rotates the handle toward the fastener gun housing. Releasing the biased power spring moves a plunger to drive a fastener into a workpiece.

Increasing the power spring's force allows a user to drive larger fasteners into a workpiece. However, such a power spring requires increased biasing forces. To increase forces available for biasing, some fastener guns increase the force required to rotate the handle toward the fastener housing. Some users are not able to exert the increased forces. Other users can exert the increased forces, but only through some of the range of handle travel. At some points of handle travel, exerting the increased forces is especially difficult, such as when initiating handle movement or just prior to releasing the power spring. Further, user's hands can exert more force in some positions than in other positions.

To increase biasing forces without increasing the handle forces, some fastener guns increase the handle size. Other fastener guns may increase the handle size to achieve current biasing forces, with reduced efforts. Some users may be unable to effectively maneuver the larger handle due to the user's hand size or other physical limitations. Although increasing the handle size is effective for increasing biasing forces, or lowering efforts while maintaining existing biasing forces, in many applications it is desirable to lower the forces without increasing the handle size.

It would be desirable to increase the forces driving a fastener from a fastener gun while accommodating a user's hand.

SUMMARY OF THE INVENTION

An example fastener gun includes a housing having a plunger and a power spring for driving a fastener into a workpiece, and a trigger arm pivotally attached to the housing at a trigger pivot. The trigger arm lifts the plunger to bias the power spring when the trigger arm pivots in a first direction. The example fastener gun also includes a handle extending upwardly from the housing and pivotally attached to the housing at a handle pivot, and a roller for pivoting the trigger arm in the first direction when the handle moves toward the housing. The roller moves away from the trigger pivot when the handle moves toward the housing.

Another example fastener gun includes a housing having a plunger and a power spring for driving a fastener into a workpiece, and a handle extending upwardly from the housing and pivotally attached to the housing at a handle pivot. A trigger arm attaches to the housing at a trigger pivot positioned between a first trigger end and a second trigger end. The first trigger end moves the plunger to bias the power spring when the trigger arm rotates in a first direction. The example fastener gun also includes a roller for moving the second trigger end with the handle and a link connecting the roller to the housing. Movement of the handle moves the roller relative to the trigger pivot. The link controls movement of the roller.

An example method for driving a fastener from a fastener gun includes biasing a power spring, decreasing a force required to bias the power spring as the spring moves from a less biased position to a more biased position, and releasing the power spring to fire the fastener.

The various features and advantages of this invention will become apparent to those skilled in the art from the following detailed description. The accompanying drawings can be briefly described as follows.

DETAILED DESCRIPTION OF THE PREFERRED EMBODIMENT

Figure 1:
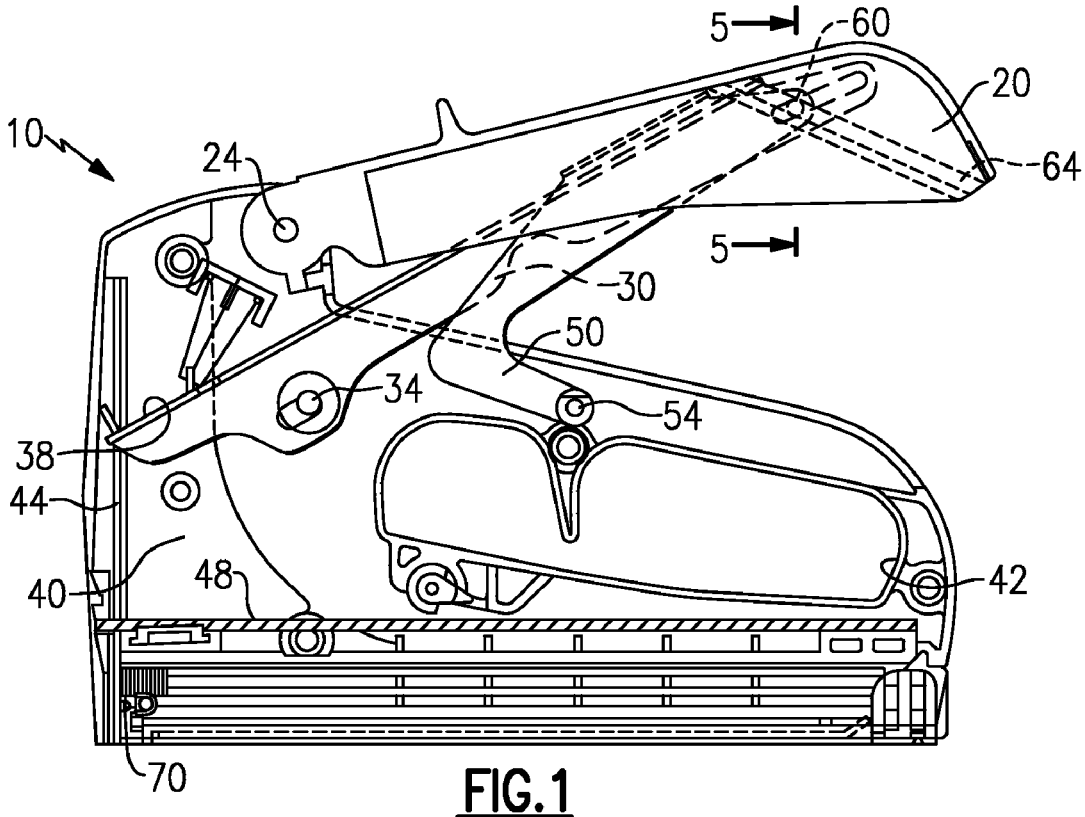
FIG. 1 shows a fastener gun in a relaxed position.

An example fastener gun 10 includes a handle 20 and a trigger arm 30 connected to a housing 40, as shown in FIG. 1. The handle 20 pivotally connects to the housing 40 at a handle pivot 24. The trigger arm 30 pivotally connects to the housing 40 at a trigger pivot 34. Moving the handle 20 toward the housing 40 in a first pivot direction pivots the trigger arm 30 about the trigger pivot 34 in the first pivot direction to lift a plunger 44 with a trigger portion 38 of the trigger arm 30. Lifting the plunger 44 biases a power spring 48, shown here in an unbiased position. As known, releasing the power spring 48 from a biased position forces the plunger 44 to drive a fastener 70 from the fastener gun 10. Rotating the handle 20 rotates the trigger portion 38 to a position that releases the plunger 44. A portion of the housing 40 has been removed in FIG. 1 to illustrate the interior of the fastener gun 10.

Figure 2:
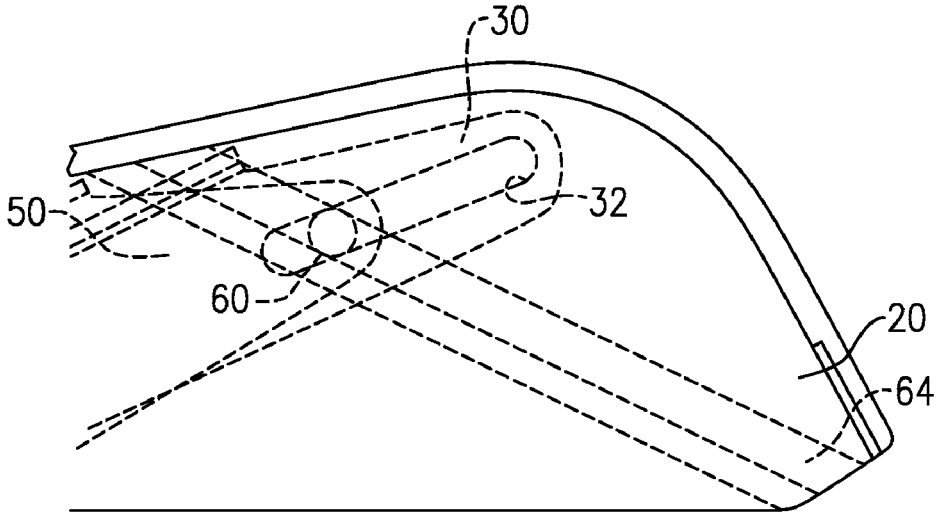
FIG. 2 shows a close-up view of the rear portion of a handle.

In this example, the handle 20 includes two handle slots 64 for controlling movement of a roller 60, as shown in the close-up view of FIG. 2. The trigger arm 30 includes a pair of trigger apertures 32 engaging the roller 60. A link 50 pivotally connects to the roller 60 and the housing 40 at a link pivot 54. The roller 60 moves within the trigger apertures 32 and the handle slots 64 as the handle 20 moves toward the housing 40.

A user's fingers grasp an opening 42 on the housing 40 while the user's palm moves the handle 20 toward the housing 40. The force applied moves the handle 20 toward the housing 40. The roller 60 within the handle 20 transfers force applied to the handle 20 to the trigger arm 30, which forces the trigger arm 30 toward the housing 40. Moving the handle 20 causes movement of the roller 60 within the handle slots 64 and the trigger apertures 32. As the handle 20 moves toward the housing 40, the roller 60 moves away from the trigger pivot 34. As the handle 20 moves away from the housing 40, the roller 60 moves toward the trigger pivot 34. Thus the location of the force applied to the trigger arm 30 relative to the trigger pivot 34 depends on the location of the handle 20 relative to the housing 40.

Figure 3A:
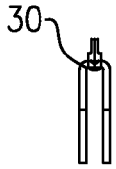
FIG. 3A shows a first view of a trigger lever.
Figure 3B:
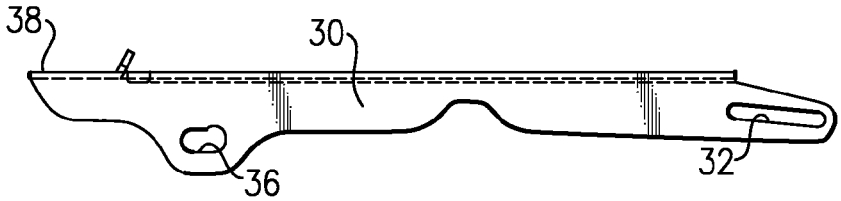
FIG. 3B shows a second view of the trigger lever.

The trigger arm 30 shown in FIGS. 3A and 3B includes the trigger apertures 32 that permits movement of the roller 60 (FIG. 2) within the handle slots 64. Movement of the roller 60 within the trigger apertures 32 changes the roller 60 location relative to the trigger pivot 34.

Figure 4A:
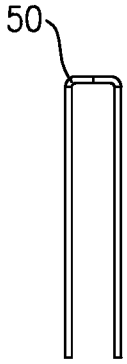
FIG. 4A shows a first view of a link.
Figure 4B:
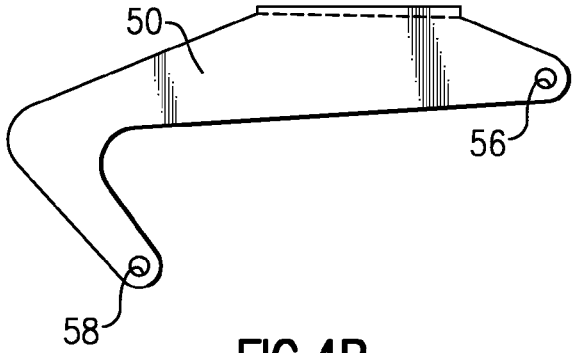
FIG. 4B shows a second view of the link.

A portion of the trigger arm 30 nests within the link 50 shown in FIGS. 4A and 4B. The link 50 includes a first end that pivotally attaches to the housing 40 at the link pivot 54. A second end of the link 50 pivotally connects to the roller 60 within the handle 20. The link 50 includes a link aperture 56 for controlling movement of the roller 60 within the handle slots 64 and the trigger apertures 32. The link 50 helps initiate and control the roller 60 movement when the handle 20 moves. The link 50 includes a second link aperture 58 for engaging the link pivot 54 of FIG. 1. The link aperture 56 engages the roller 60. The sizing of the second link aperture 56 limits the roller 60 movements relative to the link 50. Accordingly, the distance between the link pivot 54 and the roller 60 remains substantially fixed throughout the handle 20 travel. The link 50 has general dogleg profile to facilitate nesting portions of the link 50 within the handle 20.

Figure 5:
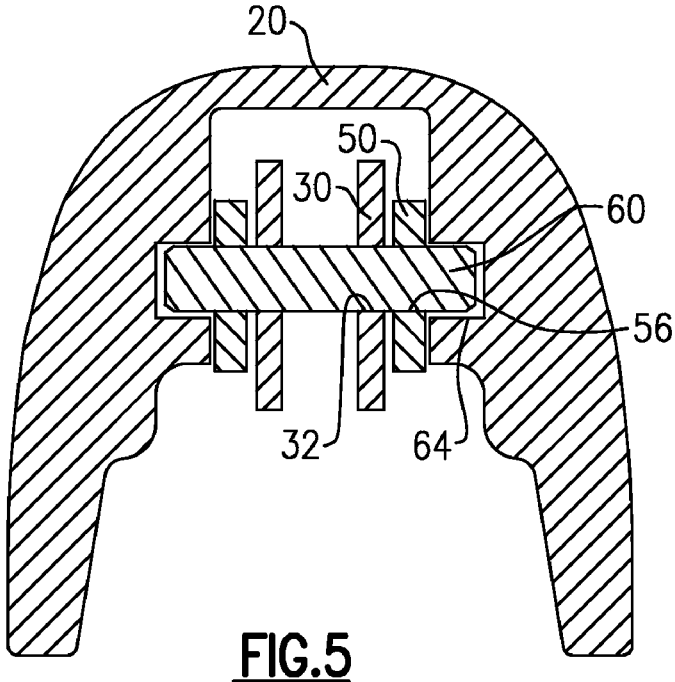
FIG. 5 shows a section view through line 5-5 of FIG. 1.

As shown in the cross-sectional view of FIG. 5, the trigger arm 30, the link 50, and the roller 60 nest within the handle 20. The roller 60 transfers movement of the handle 20 to the trigger arm 30 and the link 50. As the handle 20 moves, the roller 60 moves within the handle slots 64 (FIG. 1). The trigger arm 30 and the link 50 also move with the handle 20.

Figure 6:
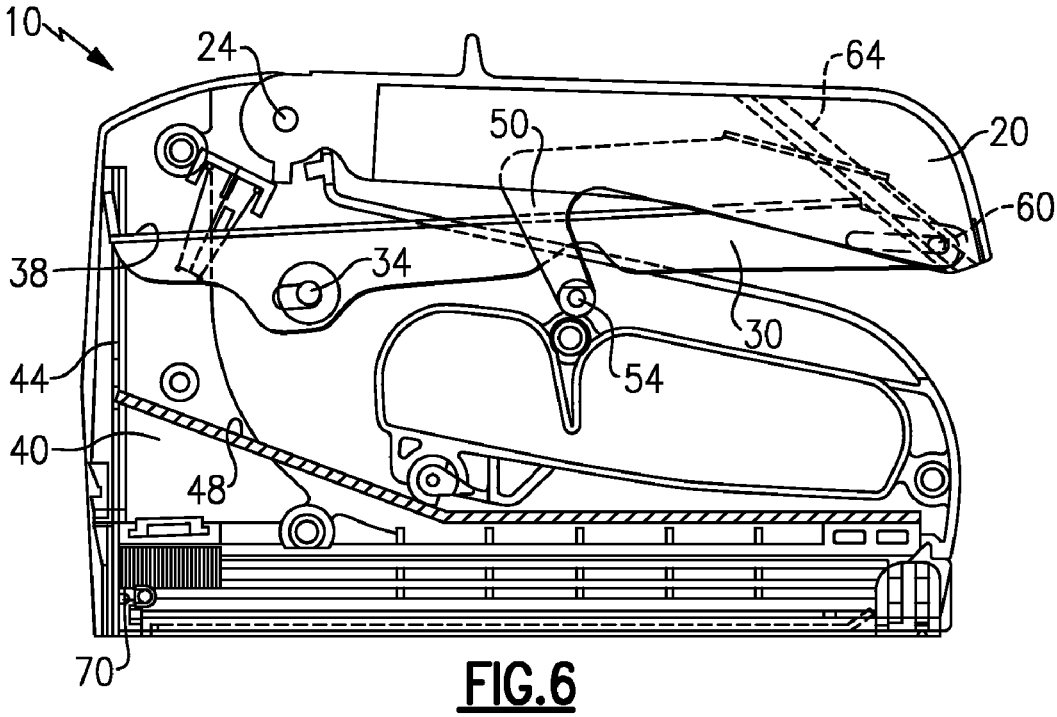
FIG. 6 shows the fastener gun with the handle in a spring biasing position.

The fastener gun 10 in FIG. 6 illustrates the power spring 48 in a biased position prior to ejecting the fastener 70. Portions of the housing 40 have been removed to reveal detail within the fastener gun 10. In the position shown, the handle 20 is closer to the housing 40 than the position of the handle 20 in FIG. 1. Moving the handle 20 further toward the housing 40 rotates the trigger portion 38 to a position that releases the plunger 44. Releasing the plunger 44 causes the power spring 48 to move from the biased position to force the plunger 44 to eject the fastener 70 from the housing 40. In this example, the fastener 70 is a staple. Other examples may include nails.

Moving the roller 60 within the handle slots 64 causes the location of the force applied to the trigger arm 30 to change as the handle 20 rotates about the handle pivot 24. In this example, the forces needed to bias the power spring 48 increase as the power spring 48 moves further from an unbiased position. Moving the roller 60 permits the forces exerted by the user on the handle 20 to remain relatively constant as the handle 20 rotates toward the housing 40. Increasing the distance between the applied force and the trigger pivot 34 increases the force applied to the plunger 44 by the trigger portion 38 instead of relying on the user to apply increased forces to the handle 20. Increasing the distance between the user applied force and the trigger pivot 34 as the handle 20 moves closer to housing 40 compensates for the increasing force applied to the plunger 44 by the power spring 48 as the power spring 48 moves away from the unbiased position.

Changing the geometry of the handle slots 64 can affect the movement of the roller 60, such as by increasing the rate of change in force applied to the trigger arm 30.

In another example, if applying a constant force to the plunger 44 is desired, increasing the distance between the applied force and the trigger pivot 34 decreases the force required to move the handle 20.

Although a preferred embodiment of this invention has been disclosed, a worker of ordinary skill in this art would recognize that certain modifications would come within the scope of this invention. For that reason, the following claims should be studied to determine the true scope and content of this invention.

I claim:

1. A fastener gun, comprising:

a housing including a plunger and a power spring for driving a fastener into a workpiece;

a trigger arm pivotally attached to said housing at a trigger pivot, said trigger arm operable to lift said plunger to bias said power spring when said trigger arm pivots about said trigger pivot;

a handle extending upwardly from said housing and pivotally attached to said housing at a handle pivot;

a member guided by said handle and operative to pivot said trigger arm about said trigger pivot when said handle moves toward said housing, and a slot in said handle operative to guide said member, wherein said member slides in said slot away from said trigger pivot when said handle moves toward said housing; and a link having a first end pivotally attached to said housing and a second end pivotally attached to said member, wherein said trigger arm nests within said link.

2. The fastener gun of claim 1, wherein said link nests within said handle.

3. The fastener gun of claim 1, wherein the link includes an aperture that receives the member.

4. A fastener gun, comprising:

a housing including a plunger and a power spring for driving a fastener into a workpiece;

a trigger arm pivotally attached to said housing at a trigger pivot, said trigger arm operable to lift said plunger to bias said power spring when said trigger arm pivots about said trigger pivot;

a handle extending upwardly from said housing and pivotally attached to said housing at a handle pivot; and a member operative to pivot said trigger arm about said trigger pivot when said handle moves about said handle pivot, and a slot in said handle operative to guide said member, wherein said member slides in said slot away from said trigger pivot when said handle pivots about said handle pivot.

5. The fastener gun of claim 4, wherein said at least one slot permits movement of said member between a position near to said trigger pivot and a position away from said trigger pivot.

6. The fastener gun of claim 4, wherein said member moves toward said trigger pivot when said handle pivots relative to said housing about said handle pivot away from said housing.

7. The fastener gun of claim 4, wherein said trigger arm includes at least two apertures each for guiding movement of an end of said member.

8. The fastener gun of claim 7, wherein said aperture is a linearly slotted aperture.

9. The fastener gun of claim 4, wherein said trigger pivot comprises a pin within a slotted aperture defined by said trigger arm.

10. The fastener gun of claim 4, including a link having a first end pivotally attached to said housing and a second end pivotally attached to said member.

11. The fastener gun of claim 4, wherein said member is a roller.

12. The fastener gun of claim 4, wherein said slot guides movement of said member away from said trigger pivot and toward said trigger pivot along a linear path.

* * * * *